US005278624A

United States Patent [19]

Kamprath et al.

[11] Patent Number: 5,278,624

[45] Date of Patent: Jan. 11, 1994

[54] DIFFERENTIAL DRIVE FOR SHEET REGISTRATION DRIVE ROLLS WITH SKEW DETECTION

[75] Inventors: David R. Kamprath, Webster; Martin E. Hoover, Rochester, both of N.Y.

[73] Assignee: Xerox Corporation, Stamford, Conn.

[21] Appl. No.: 909,845

[22] Filed: Jul. 7, 1992

[51] Int. Cl.[5] ..... G03G 21/00

[52] U.S. Cl. ..... 355/317; 271/227; 271/251

[58] Field of Search ..... 355/271, 308, 309, 316, 355/317, 208; 271/3.1, 225, 226, 227, 228, 243, 245, 246, 250, 251, 252, 253

[56] References Cited

U.S. PATENT DOCUMENTS

| | | | |
|---|---|---|---|
| Re. 33,843 | 3/1992 | Naramore et al. | 271/251 |
| 3,240,487 | 3/1966 | Templeton | 271/228 |
| 3,758,104 | 9/1973 | Daily | 271/185 |
| 3,980,296 | 9/1976 | Craft et al. | 271/251 |
| 4,076,408 | 2/1978 | Reid et al. | 355/309 |
| 4,082,456 | 4/1978 | Schroter | 355/109 |
| 4,436,403 | 3/1984 | Rhodes, Jr. et al. | 355/309 |
| 4,438,917 | 3/1984 | Janssen et al. | 271/227 |
| 4,500,086 | 2/1985 | Garavuso | 271/225 |
| 4,511,242 | 4/1985 | Ashbee et al. | 355/317 |
| 4,519,700 | 5/1985 | Barker et al. | 355/271 |
| 4,526,309 | 7/1985 | Taylor et al. | 271/227 X |
| 4,607,835 | 8/1986 | Wilson et al. | 271/227 |
| 4,919,318 | 4/1990 | Wong | 271/250 X |
| 4,971,304 | 11/1990 | Lofthus | 271/227 |
| 4,982,946 | 1/1991 | Uchimura et al. | 271/251 |
| 4,984,778 | 1/1991 | Alexander et al. | 271/117 |
| 4,994,864 | 2/1991 | Schieck et al. | 355/317 |
| 5,034,781 | 7/1991 | Watanabe | 355/317 |
| 5,078,384 | 1/1992 | Moore | 355/317 X |
| 5,094,442 | 3/1992 | Kamprath et al. | 271/227 |
| 5,136,342 | 8/1992 | Ida et al. | 355/317 |
| 5,156,391 | 10/1992 | Roller | 271/227 |
| 5,162,857 | 11/1992 | Higeta et al. | 355/317 X |
| 5,240,241 | 8/1993 | Kawazoe | 271/226 X |

FOREIGN PATENT DOCUMENTS

| | | |
|---|---|---|
| 60-2546 | 1/1985 | Japan . |
| 64-25163 | 1/1989 | Japan . |

OTHER PUBLICATIONS

M. J. Russel et al., "Means to Correct Document Skew", Research Disclosure, Nov. 1979.

*Primary Examiner*—Leo P. Picard
*Assistant Examiner*—Christopher Horgan
*Attorney, Agent, or Firm*—Oliff & Berridge

[57] ABSTRACT

A registration system for copy sheets uses a pair of drive rolls and a drive system for commonly driving both drive rolls. A differential drive mechanism is provided for changing the relative angular position of one of the rolls with respect to the other roll to deskew the copy sheet. A control system is supplied with inputs representative of the skew of the copy sheet and controls the differential drive mechanism to deskew the copy sheet. The system offers enhanced performance and reduced cost.

38 Claims, 4 Drawing Sheets

DIFFERENTIAL DRIVE FOR SHEET REGISTRATION DRIVE ROLLS WITH SKEW DETECTION

BACKGROUND OF THE INVENTION

1. Field of the Invention

This invention relates to registration of sheets in a feed path. It particularly relates to systems for controlling driving rolls to effect registration and deskewing of copy sheets.

2. Description of Related Art

Conventional sheet registration mechanisms for equipment using paper feed stocks, such as electrophotographic reproduction equipment and printers, use crossed nip rolls in conjunction with fixed guides or gates for positioning the copy sheet. The crossed nip rolls push the sheets against such guides and gates. These conventional systems have many drawbacks. If the sheet is driven against the guide and gate surfaces with excessive force, the edges of the sheets can be bent or crumpled. This condition occurs especially with light weight papers and causes problems in downstream feeding of the paper. Thus, each system must be carefully set for a narrow range of paper weight to provide sufficient driving force for movement of the sheet without damaging it as it is driven against a guide or gate. Further, the guides are subject to wear resulting from the impingement of the edges of a large number of copy sheets. Thus, the guides must be replaced one or more times during the life of a machine, thereby increasing maintenance costs. In addition, undesirable dust is formed as a result of the impact and sliding the paper against the hard guide surfaces. One system of this type, using a passive differential between spaced rolls to allow one of the rolls to rotate at a higher speed than the other of the rolls, has been proposed.

Sheet registration systems without mechanical guides or gates, using drive rolls for sheet registration, have also been proposed. Sheet registration stations of this type are shown in U.S. Pat. Nos. 4,438,917, 4,511,242, 4,971,304 and 5,049,442. In these sheet registration stations, the copy sheet is positioned longitudinally and laterally (registered) and the angular position of the copy sheet (skew) is corrected by driving two coaxial nip rolls at different speeds or by driving one roll at a constant speed and varying the drive speed of the other roll, so that one side of the sheet travels farther than the other, thus changing the angular position of the paper. Each of the two rolls is driven by an independently controlled motor. These designs present control limitations because of the requirements of precisely controlling the velocity difference between the two rolls (to achieve high positional resolution) and operating the drives at high speed (to achieve high throughput rates). This results from the fact that the drive system must accomplish two different functions with conflicting requirements. The rolls must transport the copy paper at relatively high speed, a condition in which the speed of both rolls must be exactly the same. The rolls must also correct the angular position of the copy sheet by precisely changing the relative angular position between the two rolls.

SUMMARY OF THE INVENTION

It is an object of the invention to provide high speed and precise registration of copy sheets in a feed path.

It is a further object of the invention to provide a copy sheet registration system that separates the functions of transporting the sheet and changing the angularity of the sheet into distinct subsystems.

These and other objects of the invention are achieved by the use of a single motor and control for driving both rolls to effect transport of the copy sheet. A differential drive mechanism changes the relative angular position of two drive rolls about their rotational axis to change the skew of the copy sheet.

DESCRIPTION OF THE PREFERRED EMBODIMENTS

Figure 1:
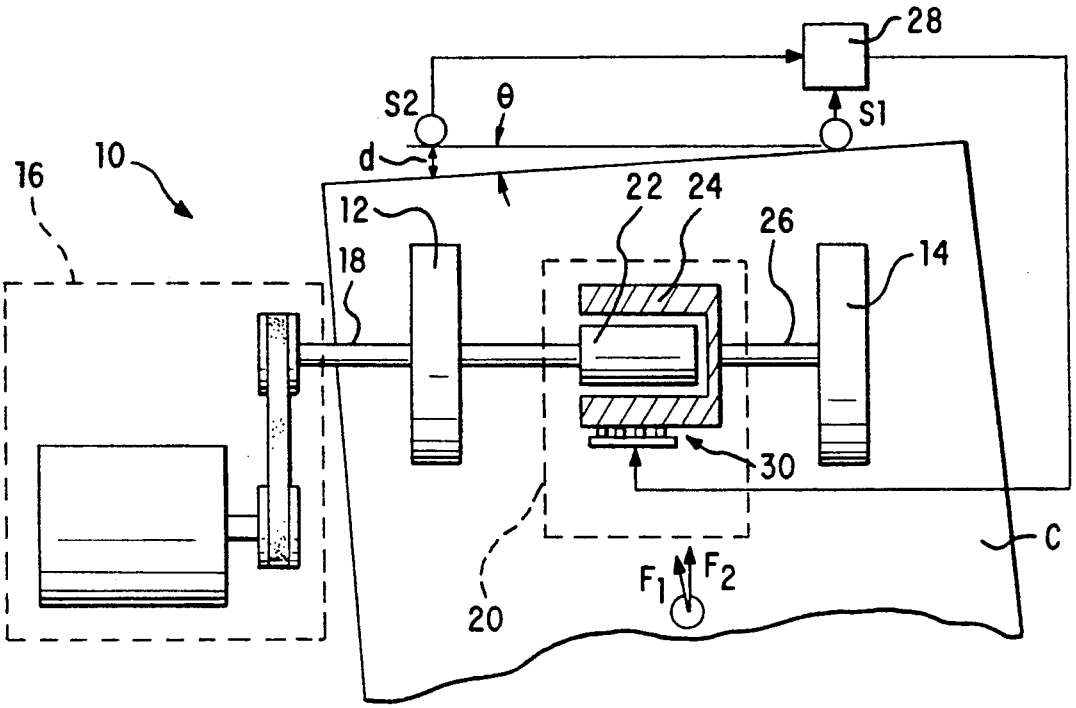
FIG. 1 is a schematic illustration of a first embodiment of a sheet registration system utilizing a motor as a differential drive.

In FIG. 1, a registration station 10 for aligning copy sheets C for further downstream processing is shown. Such stations are used to control the feed of the copy sheet along the feed path and position (register) the lead edge of the copy sheet so that it is fed in proper synchronization to a downstream work station. Such stations also align (register) the side edge of copy sheet so that it is properly registered in the transverse direction for a down work station. In addition, the station controls the angular orientation (skew) of the sheet as it is fed to downstream operations. In FIG. 1, the skew angle is represented as the angular difference between arrow F1, which represents the position of the longitudinal axis of the paper as it is fed into the registration station, and arrow F2, which represents the desired orientation of the longitudinal axis of the copy sheet as it is fed from the registration station. This angular distance is also represented by the angle $\theta$, shown in FIG. 1, which is the angle of the leading edge of the sheet prior to deskewing in relation to the desired orientation of the lead edge of the sheet as it leaves the registration station 10. In most situations it is desirable to eliminate all skew ($\theta=0°$) so that the leading edge of the sheet is perpendicular to the direction of movement of the sheet as it leaves the registration station 10.

An electronic copy sheet registration system in which the present invention can be used is shown in U.S. Pat. No. 4,971,304, the disclosure of which is incorporated by reference. Another form of registration system, termed a translating electronic registration system, in which the present invention can be used, is shown in U.S. Pat. No. 5,094,442, the disclosure of which is also incorporated herein by reference. Such registration systems accomplish the basic copy sheet registration functions discussed in the preceding paragraph.

In the embodiment shown in FIG. 1, two drive rolls 12 and 14 are rotatably mounted and are positioned to drive the copy sheet C through the registration station 10. As is conventional, in this and the other embodiments disclosed herein, rolls 12 and 14 each cooperate with a second roll (not shown) to form a roll nip pair for engaging the copy sheet in a drive nip formed between the rolls. A single rotary drive means 16 drives a shaft 18 on which the roll 12 is fixedly mounted. A differential drive 20 is located between the shaft 18 and the roll 14. In this embodiment, the differential drive comprises a rotatable motor 20 having a rotor 22 fixed to the end of shaft 18 opposite drive 16. The motor 20 can be any of several types of motors in which relative rotation between the rotor and stator can be locked. A preferred type of motor for this purpose is a stepper motor. The motor 20 includes a stator 24 fixed to a rotatable shaft 26. The roll 14 is fixedly mounted on the shaft 26. The axes of rotation of shaft 18 and shaft 26 are coincident. Rotational contacts 30 supply electrical power to motor 20.

In operation, drive 16 rotates shaft 18 which in turn rotates roll 12 and rotor 22. When the rotor 22 and stator 24 are locked, by signals supplied by controller 28 to rotational contacts 30, the stator 24 is rotated by rotor 22, thereby rotating shaft 26 and roll 14. In this condition, the rolls 12 and 14 are driven at the same speed, since the rotor 22 and stator 24 are locked.

When a sheet C passes through the registration station C, the amount of skew in the sheet can be sensed by a sensing system that comprises a pair of spaced sensors S1 and S2. The amount of skew is detected by the difference in time at which the leading edge of the sheet passes each of the sensors. That time difference is represented by the distance d, which directly relates to the amount of angular skew $\theta$ of the copy sheet. The outputs of sensors S1 and S2 are supplied to a controller 28 that evaluates the amount of skew and provides an appropriate control signal to the stepping motor comprising the rotor 22 and stator 24. By providing an appropriate number of pulses to the contacts 30 and appropriate directional information, the angular position of the roll 14 with respect to the roll 12, about the axis of rotation of these rolls, is precisely changed to change the angular position of the copy sheet C. The angular adjustment of roll 14 with respect to roll 12 takes place while the rolls 12 and 14 continue to drive the copy sheet, at high speed, through the registration station 10.

The controller 28 can comprise a microprocessor suitable programmed, for example with a look up table, for providing the number of pulses and the directional aspect of the signal applied to contacts 30 in relation to the amount of skew detected and the drive speed of the drive 16. Programs for implementing such a control system involve routine programming skill and no further explanation thereof is necessary.

An important aspect of the present invention is that the differential drive directly changes the relative angular position of the rolls, which is the action precisely required to change the angular position of the copy sheet, but does not substantially change the velocity of the rolls, one with respect to the other. In this embodiment and the other described embodiments, each of the sheet drive 16 and differential drive 20 are dedicated to a single function. This allows each function to be optimized to improve performance of that function. The optimization can be achieved with enhanced results and at lower costs because of the dedicated function of the respective drives. In addition, the deskewing function is distributed over both rolls and is achieved more quickly.

Figure 2:
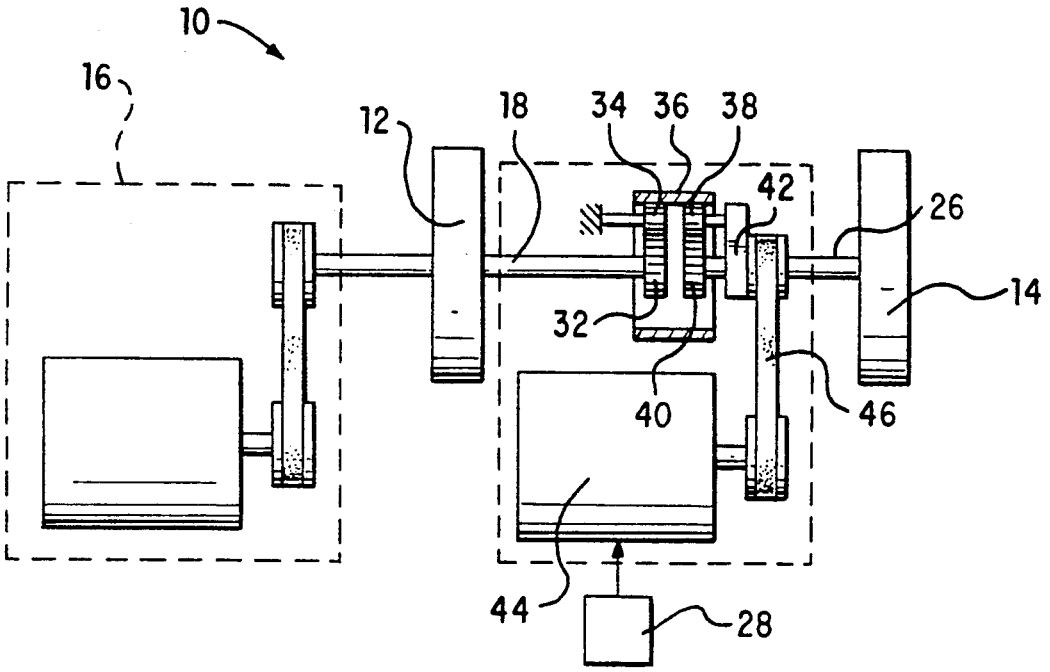
FIG. 2 is a schematic illustration of a second embodiment of a sheet registration system utilizing a planetary gear arrangement for the differential drive.

FIG. 2 shows a second embodiment of a copy sheet registration station 10 utilizing another form of differential drive. Elements common with the FIG. 1 embodiment are similarly numbered. This arrangement includes the drive nip rolls 12 and 14. The roll 12 is mounted on shaft 18 which is driven by the drive 16. The roll 14 is mounted on a shaft 26, the axis of rotation of which is coincident with the axis of rotation of shaft 18. In this embodiment, the differential drive means includes a spur gear 32 fixed to an end of shaft 18 opposite drive 16, a fixed position idler gear 34, a ring gear 36, a planet gear 38 and a sun gear 40. The sun gear 40 is fixed onto one end of the shaft 26. The planet gear 38 is carried on a rotatable planetary arm 42, that is mounted for rotation about shaft 26. Thus, the axis of rotation of planet gear 38 can be moved about shaft 26. Thus, the axis of rotation of planet gear 38 can be moved about the axis of the shaft 26. A motor 44, preferably a stepping motor, drives the planetary arm 42 by a suitable transmission system 46, to rotate about the axis of rotation of shaft 26. The station 10 includes a copy sheet position sensing system of the type shown in FIG. 1.

In a sheet translating mode, the rolls 12 and 14 are driven at the same speed by the differential system comprising the gears 32, 34, 36, 38 and 40. In this condition, the motor 44, which is not being driven, holds arm 42 in place through the transmission 46. In a deskew mode, the controller 28 provides pulses of appropriate number and direction to the motor 44 to rotate the planetary arm 42 in an appropriate direction and by an appropriate amount about the axis of shaft 26 to correct for the skew. If the arm 42 is moved in the direction of rotation of ring gear 36, the angular position of roll 12 is advanced with respect to roll 14. If the arm 42 moved counter to the direction of rotation of ring gear 36, roll 14 is angularly advanced with respect to roll 12. By such relative angular shifting of the rolls 12 and 14, the skew of the copy sheet is controlled.

Figure 3:
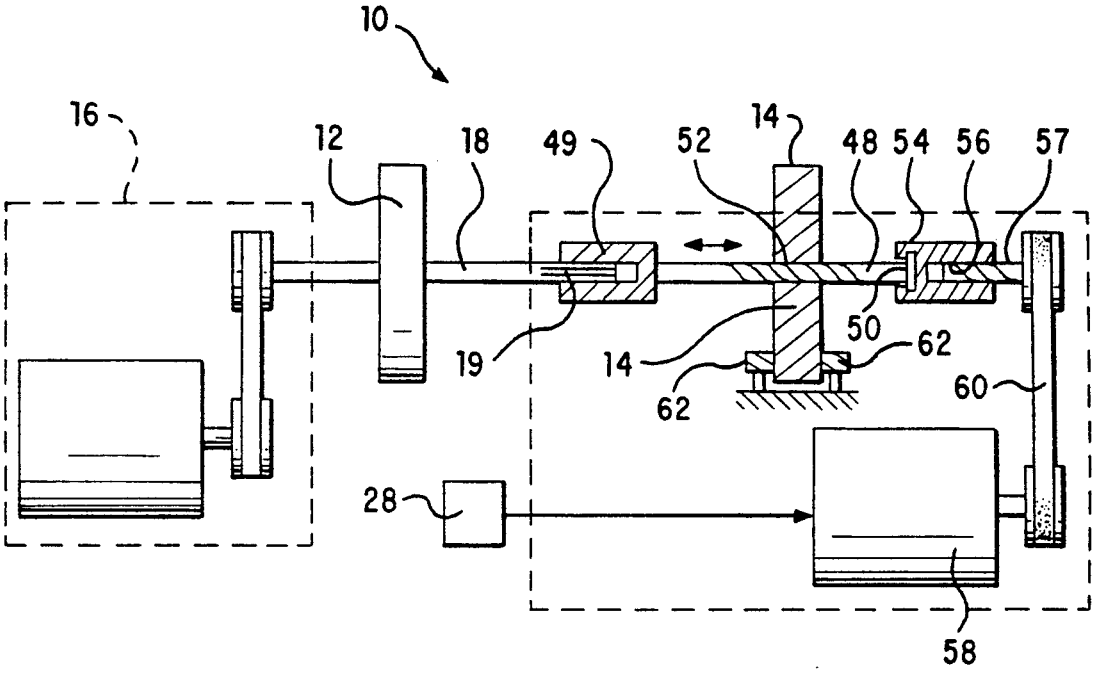
FIG. 3 is a schematic illustration of a third embodiment of a sheet registration system utilizing an axially movable shaft for effecting a differential drive.

In FIG. 3, a third embodiment utilizing another type of differential drive is shown. This arrangement includes the rolls 12 and 14 and the sheet drive 16 for driving the shaft 18. The end of the shaft 18 opposite the drive 16 includes a plurality of splines 19. A slidable coupling 49 is received on the end of shaft 18 and includes grooves for drivably engaging the splines 19. The slidable coupling 49 is fixed at one end to a transversely slidable shaft 48 on which is mounted the roll 14. The portion of the shaft 48 on which the roll 14 is mounted includes a helical groove 52 which is engaged by appropriate thread-like projections carried by the roll 14.

The shaft 48 is translated by means of a slip coupling 54 which includes a recess for rotatably receiving the head 50 of one end of the shaft 48. The slip coupling 54 includes a bore 56 that receives a stub shaft 57. The stub shaft 57 threadably engages the bore 56 of the slip coupling 54. A suitable motor 58, such as a stepping motor, drives the stub shaft 57 through a suitable transmission 60. A pair of opposed stops 62 fix the lateral position of the roll 14 but have sufficient clearance to allow rotation of the roll.

The differential drive system shown in FIG. 3 operates as follows. When the axial position of shaft 48 is fixed, the sheet drive 16 drives both rolls 12 and 14 at the same speed through slidable coupling 49 and splines 19. When deskewing is to be effected, the controller 28 provides control signals for controlling the direction and amount of rotation of the motor 58, which is in turn transmitted to the stub shaft 57. The input for controller 28 is derived from a position sensing system as shown in FIG. 1. Rotation of the stub shaft causes the slip coupling 54 to move transversely in a direction governed by the direction of rotation of the stub shaft 57. Transverse movement of the slip coupling 54 is transmitted by the captured head 50 to the drive shaft 48. Transverse movement of the shaft 48 is enabled by reason of the slidable coupling 49. As the shaft 48 is moved transversely, the helical groove 52 imparts rotation to the roll 14, because the roll is captured between the stops 62. This changes the angular position of the roll 14 with respect to the roll 12 to effect deskewing of the copy sheet.

Figure 4:
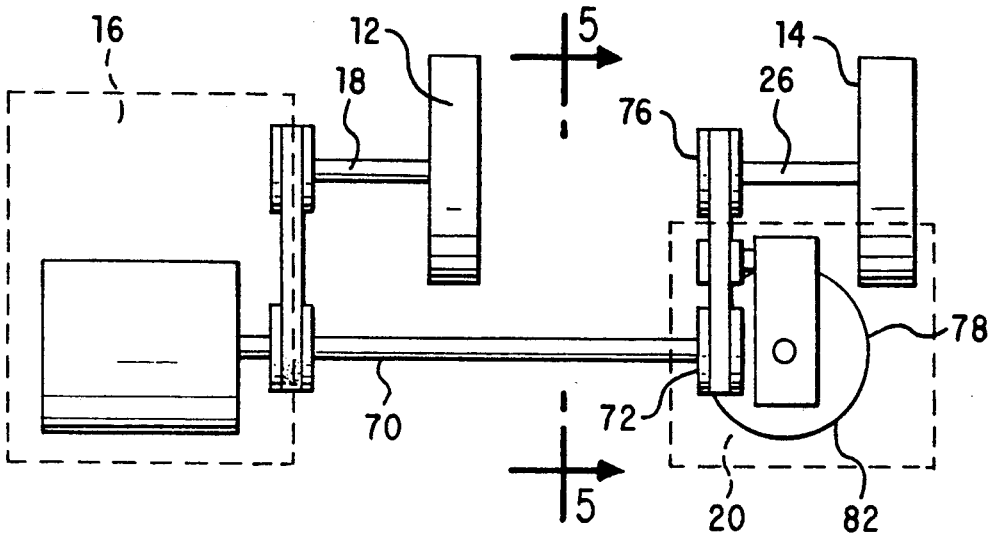
FIG. 4 is a schematic illustration of a fourth embodiment of differential drive utilizing a belt.

In FIG. 4, a fourth embodiment of differential drive utilizing a belt is shown. As in the foregoing descriptions, elements common with previous embodiments are like numbered. In this embodiment, the drive means 16 drives a shaft 18 to drive the roll 12. The drive 16 also includes a means for driving the roll 14. In this embodiment, such means comprises a shaft 70, which can be a shaft extension extending directly from motor 16 or can be a shaft driven by shaft 18 (through a suitable transmission, not shown). The shaft 70 carries a drive member such as pulley 72. A drive belt 74 is driven by the pulley 72 and is entrained over a drive member such as a pulley 76, for rotating the shaft 26, to drive the roll 14.

This drive system also includes a motor 74, preferably a stepping motor, having an output shaft 80 on which there is formed a helical groove or thread 81. The shaft 80 is received in a corresponding threaded or groove engaging opening in a movable mount 82. The movable mount 82 serves as a mounting for an idler pulley 84, which engages the belt 74. Opposite the idler pulley 84 is a second idler pulley 86 mounted on a movable mounting plate 88 that is secured by a tension spring 90 onto a fixed portion of the apparatus. The plate 88 and spring 90 form a follower assembly. Alternatively, the pulleys 84 and 86 could be mounted on a single carrier (not shown) transversely movable by the motor 78.

Figure 5:
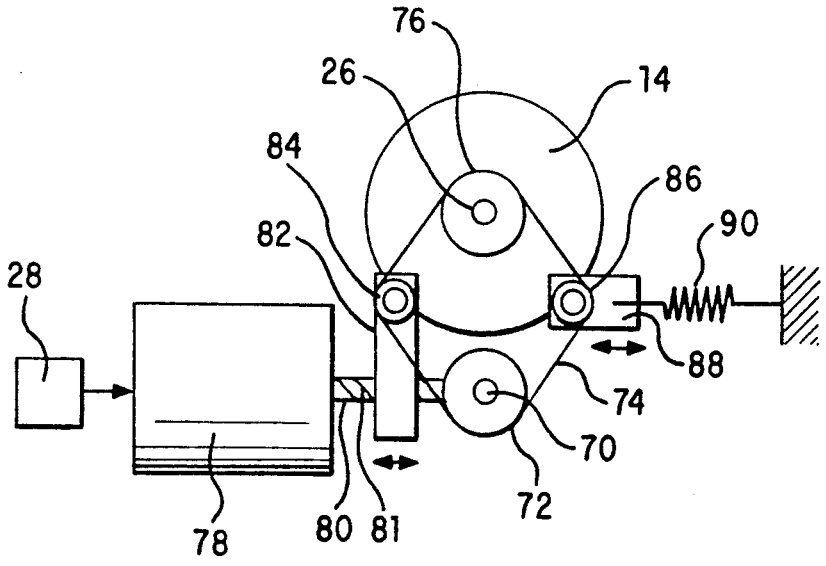
FIG. 5 is a side elevational view of the embodiment of FIG. 4 taken along line 5—5 and rotated by 90°.

The differential drive shown in FIGS. 4 and 5 operates as follows. When it is desired to have the rolls 12 and 14 rotate in unison, the motor 78 is maintained quiescent by the controller 28. Upon the detection of skew, as previously described, the controller 28 energizes motor 78 to rotate shaft 80 in an appropriate direction and by an appropriate amount to change the position of mount 82, thereby changing the lateral position of idler pulley 84. If, for example, the idler pulley 84 is drawn to the left, the left hand side of the run of belt 74 is increased and the length of the right hand side of the run of belt 74 is correspondingly decreased. By reason of the spring 90, the idler pulley 86 can follow the movement of the pulley 84. When the length of the left hand side of the run of the belt is increased, the pulley 76 and thus the roll 14 is rotated in a counterclockwise direction. Conversely, if the mount 80 is moved toward the right in FIG. 5, the length of the run of the left hand side of the run of belt 74 is decreased and the length of the run of the right hand side of the belt 74 is increased, by reason of the pulley 86 being pulled to the right by tension spring 90, thereby rotating the pulley 76 and thus roll 14 in a clockwise direction. The length of belt 74 that is shifted from one side to the other of the axis of rotation of shaft 26 imparts rotation to pulley 76, in accordance with the direction of shift, thereby changing the relative angular position of roll 14 with respect to roll 12. As in the preceding embodiments, the functions of driving the rolls for translation of the copy sheet and changing the relative angular position of the rolls for controlling skew are independent and more readily controlled.

The present invention is advantageous because the sheet transporting function can be optimized by control of a single drive system without regard to requirements for changing the angular position of the rolls, one with respect to the other. The precision of the deskewing operation is optimized by the differential drive system that only changes the relative angular position of one of the drive rolls with respect to the other. Also, the requirements imposed on the control system are reduced because it is not necessary to supply command signals, at high speeds, to control deskewing. Further, in comparison with systems in which only one roll is controlled to effect deskewing, the present invention distributes the deskewing function over both rolls, thereby achieving faster deskewing of the copy sheet. When the differential drive system is not operating, the rolls operate at exactly the same speed. As a result, the performance of the registration system is enhanced and its cost is reduced.

What is claimed is:

1. A sheet registration comprising:
a first rotatable roll for driving a sheet;
a second rotatable roll, spaced laterally from first roll, for driving a sheet;
a single drive motor for commonly driving the first and second rolls;
a differential drive means for changing the angular rotational position of one of the rolls differentially with respect to the angular rotational position of the other roll; and
control means for sensing skew in a sheet and controlling the differential drive means in relation to the amount of skew sensed.

2. Apparatus as in claim 1, wherein an axis of rotation of the first roll is coincident with an axis of rotation of the second roll.

3. Apparatus as in claim 1, wherein the differential drive means comprises a controllable member drivingly positioned between the first roll and the second roll.

4. Apparatus as in claim 3, wherein the controllable member comprises a motor having a first part and a second part, said first and second parts being rotatable, one with respect to the other.

5. Apparatus as in claim 4, wherein the first part comprises a rotor and the second part comprises a stator.

6. Apparatus as in claim 5, wherein the rotor is drivingly connected to the first roll and the stator is drivingly connected to the second roll.

7. Apparatus as in claim 6, wherein the motor is a stepping motor.

8. Apparatus as in claim 1, wherein the differential drive means comprises a planetary drive, drivingly positioned between the first and second rolls.

9. Apparatus as in claim 8, wherein the planetary drive includes a rotary arm and a drive member mounted on the rotary arm for driving the second roll.

10. Apparatus as in claim 9, further comprising a second drive for rotating the rotary arm.

11. Apparatus as in claim 10, wherein the second roll includes a drive shaft and the rotary arm is mounted for rotation with respect to an axis of rotation of the drive shaft.

12. Apparatus as in claim 1, wherein the differential drive means comprises a first drive shaft for driving the second roll; means for mounting the drive shaft for transverse movement with respect to the second roll, means for moving first the drive shaft transversely, and translational means cooperative between the first drive shaft and the second roll for rotatably driving the drive roll in response to transverse movement of the drive shaft.

13. Apparatus as in claim 12, wherein the translational means comprise a helical groove on an outer surface of the first drive shaft and means on the second roll for engaging the helical groove.

14. Apparatus as in claim 13, further comprising a second drive shaft for driving the first roll and a slidable coupling for rotatably coupling the first and second drive shafts and allowing axial sliding movement of the first drive shaft with respect to the second drive shaft.

15. Apparatus as in claim 1, wherein the differential drive means comprises:

an endless belt for driving the second rotatable roll, said belt having a first run length disposed on a first side of an axis of rotation of the second roll and a second run length disposed on a second side of the axis of rotation of the roll opposite to the first side; and run length changing means for changing the first and second run lengths of the belt.

16. Apparatus as in claim 15, wherein the run length changing means includes means for lengthening one of the first and second run lengths and correspondingly shortening the other of the first and second run lengths.

17. Apparatus as in claim 16, wherein the run length changing means comprises a pair of opposed pulleys, one of the pair of pulleys engaging the first run length of the belt and the other of the pair of pulleys engaging the second run length of the belt.

18. Apparatus as in claim 17, wherein the run length changing means comprises means for moving the pair of pulleys transversely with respect to the axis of rotation of the second roll.

19. A copy sheet registration apparatus comprising:

means defining a copy sheet path;

determining means for determining the amount of skew in a copy sheet in said copy sheet path;

determing means for determining the amount of skew in a copy sheet in said copy sheet path;

means for moving a copy sheet in the copy sheet path and controlling the skew of the copy sheet comprising:

a first rotatable roll for driving a sheet;

a second rotatable roll, spaced laterally from said first roll, for driving a sheet;

a first drive means for commonly driving the first and second rolls; and a differential drive means for changing the angular rotational position of one of the first and second rolls differentially with respect to the angular rotational position of the other roll without changing the speed of said first and second rolls; and means responsive to the determining means for controlling the differential drive means to control the skew of the copy sheet.

20. Apparatus as in claim 19, wherein an axis of rotation of the first roll is coincident with an axis of rotation of the second roll.

21. Apparatus as in claim 20, wherein the differential drive means comprises a controllable member drivingly positioned between the first roll and the second roll.

22. Apparatus as in claim 21, wherein the controllable member comprises a motor having a first part and a second part, said first and second parts being rotatable, one with respect to the other.

23. Apparatus as in claim 22, wherein the first part comprises a rotor and the second part comprises a stator.

24. Apparatus as in claim 23, wherein the rotor is drivingly connected to the first roll and the stator is drivingly connected to the second roll.

25. Apparatus as in claim 24, wherein the motor is a stepping motor.

26. Apparatus as in claim 19, wherein the differential drive means comprises a planetary drive, drivingly positioned between the first and second rolls.

27. Apparatus as in claim 26, wherein the planetary drive includes a rotary arm and a drive member mounted on the rotary arm for driving the second roll.

28. Apparatus as in claim 27, further comprising a second drive for rotating the rotary arm.

29. Apparatus as in claim 28, wherein the second roll includes a drive shaft and the rotary arm is mounted for rotation with respect to an axis of rotation of the drive shaft.

30. Apparatus as in claim 19, wherein the differential drive means comprises: a first drive shaft for driving the second roll; means for mounting the first drive shaft for transverse movement with respect to the second roll, means for moving the first drive shaft transversely, and translational means cooperative between the drive shaft and the second roll for rotatably driving the drive roll in response to transverse movement of the first drive shaft.

31. Apparatus as in claim 30, further comprising:

wherein the translational means comprise a helical groove on an outer surface of the first drive shaft and means on the second roll for engaging the helical groove.

32. Apparatus as in claim 31, further comprising a second drive shaft for driving the first roll and a slidable coupling for rotatably coupling the first and second drive shafts and allowing axial sliding movement of the first drive shaft with respect to the second drive shaft.

33. Apparatus as in claim 19, wherein the differential drive means comprises:

an endless belt for driving the second rotatable roll, said belt having a first run length disposed on a first side of an axis of rotation of the second roll and a second run length disposed on a second side of the axis of rotation of the roll opposite to the first side; and run length changing means for changing the first and second run lengths of the belt.

34. Apparatus as in claim 15, wherein the run length changing means includes means for lengthening one of the first and second run lengths and correspondingly shortening the other of the first and second run lengths.

35. Apparatus as in claim 16, wherein the run length changing means comprises a pair of opposed pulleys, one of the pair of pulleys engaging the first run length of the belt and the other of the pair of pulleys engaging the second run length of the belt.

36. Apparatus as in claim 17, wherein the run length changing means comprises means for moving the pair of pulleys transversely with respect to the axis of rotation of the second roll.

37. A sheet registration apparatus comprising:

means defining a sheet feed path;

a first rotatable roll for feeding a sheet;

a second rotatable roll, spaced laterally from said first roll, for feeding a sheet;

a drive means for commonly driving the first and second rolls;

a differential drive means located between said first rotatable roll and said second rotatable roll for changing the angular rotational position of one of the first and second rolls differentially with respect to the angular rotational position of the other roll; and control means for sensing skew in a sheet being fed in said sheet feed path means and controlling the differential drive means in relation to the amount of skew sensed.

38. A sheet registration apparatus comprising:

means defining a sheet feed path;

a first rotatable roll for feeding a sheet;

a second rotatable roll, spaced laterally from said first roll, for feeding a sheet;

a drive motor for commonly driving the first and second rolls, said drive motor being connected to said first roll;

a differential drive means for changing the angular rotational position of one of the first and second rolls differentially with respect to the angular rotational position of the other roll; and control means for sensing skew in a sheet being fed in said sheet feed path means and controlling the differential drive means in relation to the amount of skew sensed;

wherein said differential drive means connects said second roll to said motor.

* * * * *